US009662527B2

(12) United States Patent
Slayton

(10) Patent No.: US 9,662,527 B2
(45) Date of Patent: May 30, 2017

(54) EXERCISE DEVICE

(71) Applicant: Douglas Slayton, Oyster Bay Cove, NY (US)

(72) Inventor: Douglas Slayton, Oyster Bay Cove, NY (US)

( * ) Notice: Subject to any disclaimer, the term of this patent is extended or adjusted under 35 U.S.C. 154(b) by 0 days.

(21) Appl. No.: 14/837,260

(22) Filed: Aug. 27, 2015

(65) Prior Publication Data

US 2017/0021217 A1 Jan. 26, 2017

Related U.S. Application Data

(60) Provisional application No. 62/195,331, filed on Jul. 22, 2015.

(51) Int. Cl.

| | |
|---|---|
| ***A63B 21/04*** | (2006.01) |
| ***A63B 21/055*** | (2006.01) |
| ***A63B 21/00*** | (2006.01) |
| ***A63B 23/12*** | (2006.01) |

(52) U.S. Cl.

CPC ..... *A63B 21/0442* (2013.01); *A63B 21/0555* (2013.01); *A63B 21/4035* (2015.10); *A63B 23/12* (2013.01)

(58) Field of Classification Search

CPC ..... A63B 21/0442; A63B 21/0555; A63B 21/4035; A63B 23/12

See application file for complete search history.

(56) References Cited

U.S. PATENT DOCUMENTS

| | | | | |
|---|---|---|---|---|
| 3,519,269 | A | 7/1970 | Howlett et al. | |
| 5,013,035 | A * | 5/1991 | Nathaniel | A63B 21/16 482/129 |
| 5,536,228 | A * | 7/1996 | Tanner, Jr. | A63B 21/0552 482/121 |
| 5,660,445 | A | 8/1997 | Murray | |
| 5,816,984 | A | 10/1998 | Weiss | |
| 5,820,532 | A | 10/1998 | Oliver | |
| 7,410,450 | B1 * | 8/2008 | Paulding | A63B 21/0552 482/120 |
| 8,834,331 | B1 * | 9/2014 | Boatwright | A63B 21/0442 482/121 |
| 9,050,493 | B2 | 6/2015 | Perez | |
| 2003/0116688 | A1 * | 6/2003 | Furukawa | A47F 5/0006 248/339 |
| 2003/0186792 | A1 * | 10/2003 | Keeler | A63B 21/0004 482/129 |
| 2006/0199706 | A1 | 9/2006 | Wehrell | |
| 2014/0088466 | A1 | 3/2014 | Hansen | |

* cited by examiner

*Primary Examiner* — Loan H Thanh
*Assistant Examiner* — Megan Anderson
(74) *Attorney, Agent, or Firm* — Karl F. Milde, Jr.; Eckert Seamans Cherin & Mellott, LLC

(57) ABSTRACT

An exercise device, which facilitates use of elastic bands, includes (a) a substantially planar base member configured to lay or be mounted on the floor, mounted on a wall or mounted on another piece of exercise apparatus; (b) at least one elongate upstanding post member affixed to the base member and extending substantially perpendicular to it; and (c) at least two elongate bars affixed to the post member and extending substantially parallel to each other and to the base member. The device, so configured, allows one or more exercise bands to be wrapped about the bars for quick and easy attachment to the fixed object (floor, wall or other device) to permit exercise with such bands.

15 Claims, 11 Drawing Sheets

EXERCISE DEVICE

CROSS-REFERENCE TO RELATED APPLICATION

This application claims priority from Provisional Application No. 62/195,331 filed Jul. 22, 2015, and entitled "EXERCISE DEVICE."

BACKGROUND OF THE INVENTION

The present invention concerns an exercise device which facilitates the use of elastic bands for exercise.

Elastic bands, which may be either round or flat in cross-section, are frequently used to exercise and strengthen arm or leg muscles, for physical therapy and/or for aerobic exercises of the body. The bands are stretched against their elastic force by pulling their opposite ends apart or by attaching one end to a fixed object and pulling the opposite end.

Various devices and methods have been devised for attaching one end of an elastic band to an object. One method is to loop the free end of the band around a hook, a bar or an eyelet, as is disclosed for example in the U.S. Pat. No. 9,050,493. This requires the free end of the band to have a ring or loop, or to be tied in a knot. The U.S. Pat. No. 8,834,331 discloses a "pronged" connector for attaching elastic bands together and also a method for securing the elastic bands to a fixed object using this connector.

The pronged connector 10 shown in FIGS. 1-5 and 8 of this patent reference includes a base element 11 and three "prongs" 12, 13 and 14. The connector is used by the methods taught in the reference to create a closed loop for attachment to an object. The band is looped around the object and then connected to itself using the pronged connector.

SUMMARY OF THE INVENTION

A principal object of the present invention is to provide a device that enables the quick and easy attachment of the free end of an elastic band to a fixed object, such as a floor, a wall or a part of another exercise device.

This object, as well as further objects which will become apparent from the discussion that follows, are achieved, according to the present invention, by providing (a) a substantially planar base member configured to lay or be mounted on the floor, mounted on a wall or mounted on another piece of exercise apparatus; (b) at least one elongate upstanding post member affixed to the base member and extending substantially perpendicular to it; and (c) at least two elongate bars affixed to the post member and extending substantially parallel to each other and to the base member. The device, so configured, allows one or more exercise bands to be wrapped about the bars for quick and easy attachment to the fixed object (floor, wall or other device) to permit exercise with such bands.

Preferably two elongate post members are affixed to the base member on opposite sides thereof so that two elastic bands can be attached, one to each post, for exercise with both arms and/or legs, one band for each. The two post members extend substantially parallel to each other and are substantially perpendicular to the base member.

Preferably also, each post member has three bars affixed to it and extending substantially parallel to each other and to the base member. The bars may extend outward on only one side of the post member but preferably extend outward on two opposite sides or even at three or four positions spaced apart equally around the post member.

The bars of the exercise device are configured to retain exercise bands of either a flat or a round cross-section.

Preferably the bars have a textured surface to increase their friction with the exercise bands. Alternatively or in addition, the bars are made of a metal covered with a polymer layer to increase their friction. The layer may be made of a rubber, a plastic foam or a plastic elastomer.

According to another aspect of the present invention, the post member may be attached directly to a floor, wall surface or a part of another exercise device. In this case, bars on the post member extend outward on two opposite sides of the post member or at three or four positions thereon, spaced apart equally around the post member.

As in the case of the exercise device described above, the bars of the exercise device are configured to retain exercise bands of either a flat or a round cross-section. Preferably the bars have a textured surface to increase their friction with the exercise bands. Alternatively or in addition, the bars are made of a metal covered with a polymer layer to increase their friction. The layer may be made of a rubber, a plastic foam or a plastic elastomer.

For a full understanding of the present invention, reference should now be made to the following detailed description of the preferred embodiments of the invention as illustrated in the accompanying drawings.

DETAILED DESCRIPTION OF THE PREFERRED EMBODIMENTS

Figure 1:
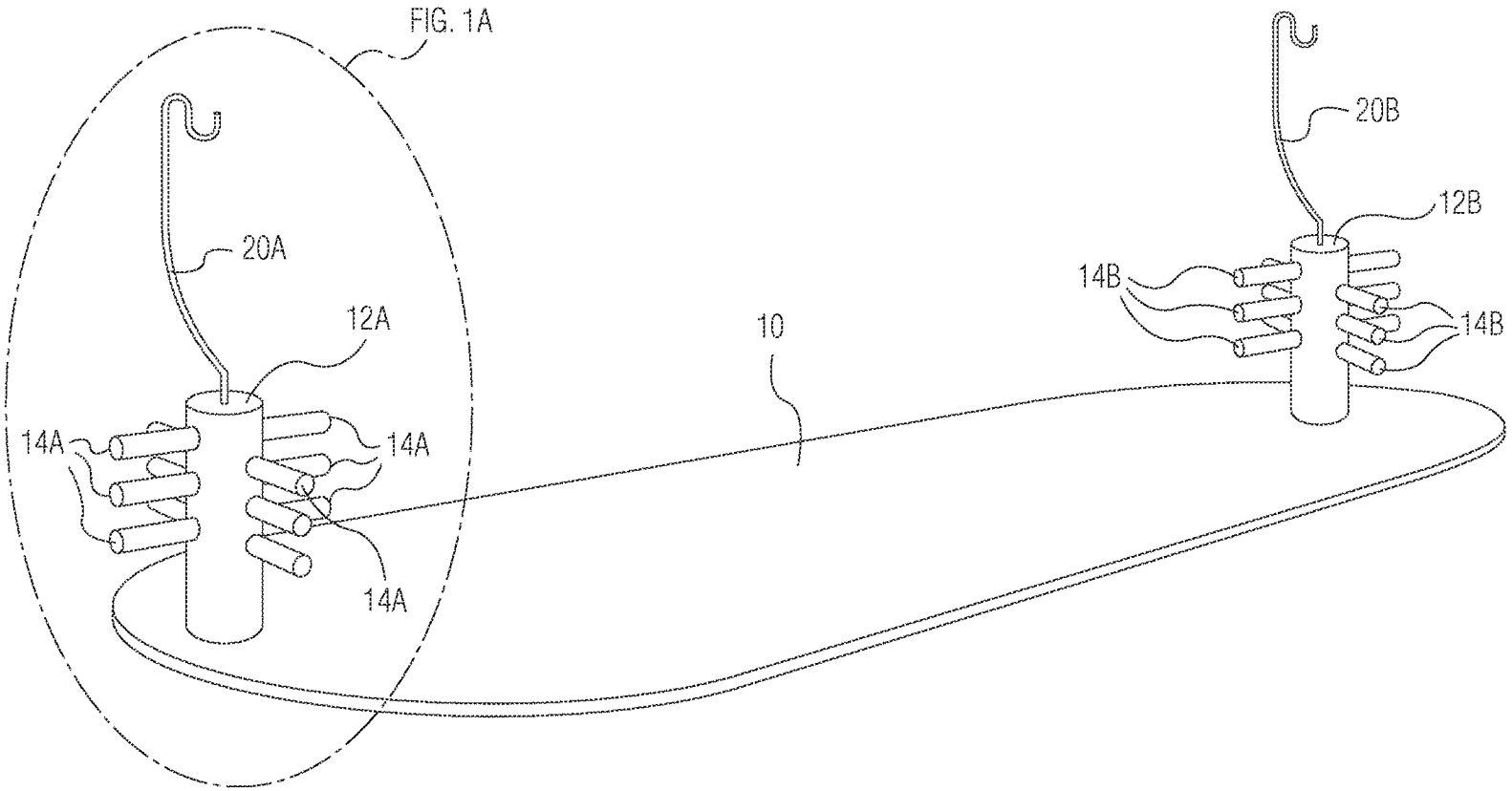
FIG. 1 is a perspective view of the exercise device according to the invention.

The preferred embodiments of the present invention will now be described with reference to FIGS. 1-9 of the drawings. Identical elements in the various figures are identified with the same reference numerals.

Figure 1A:
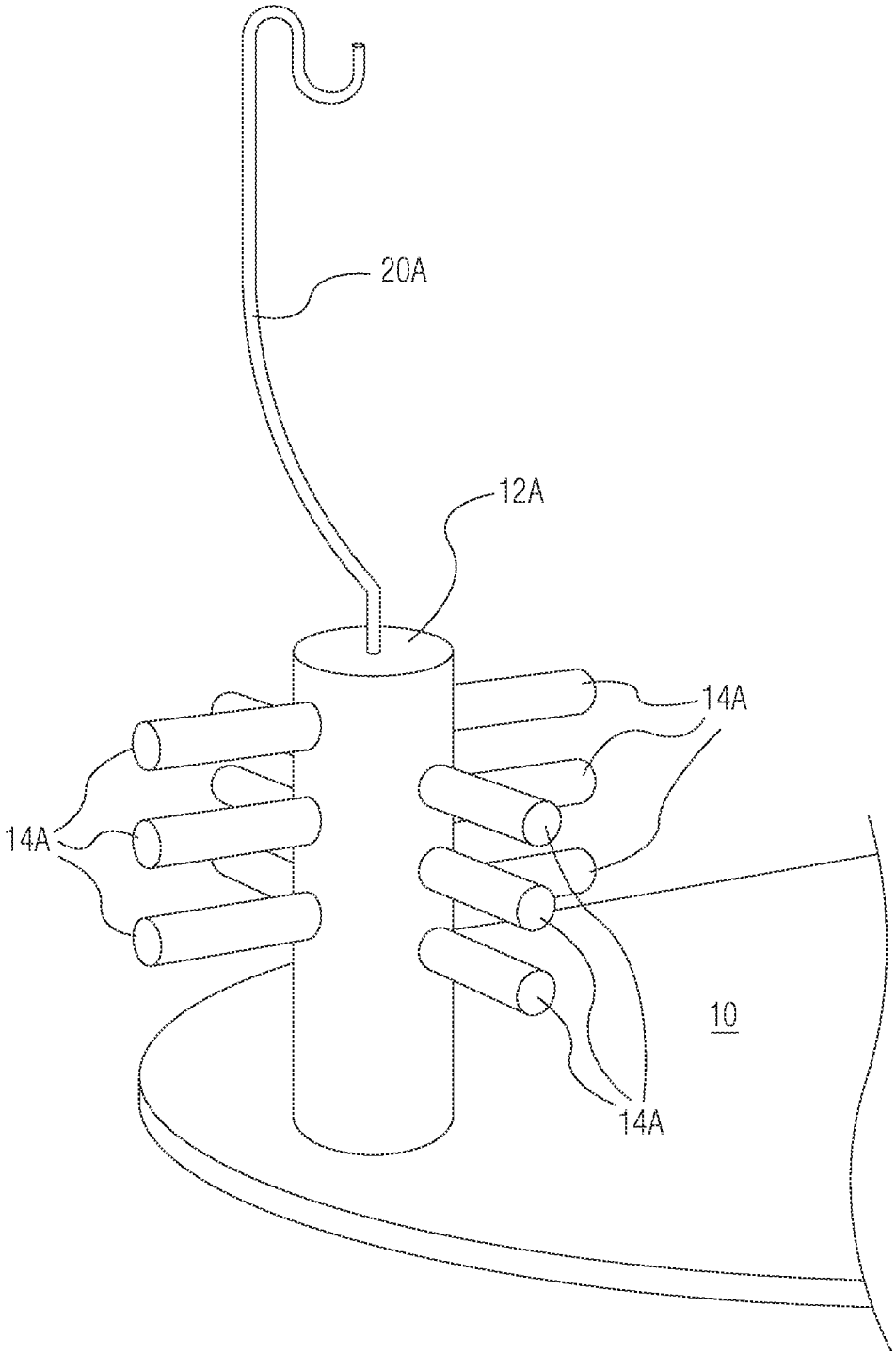
FIG. 1A is a perspective, detailed view of a portion of the exercise device shown in FIG. 1.
Figure 2A:
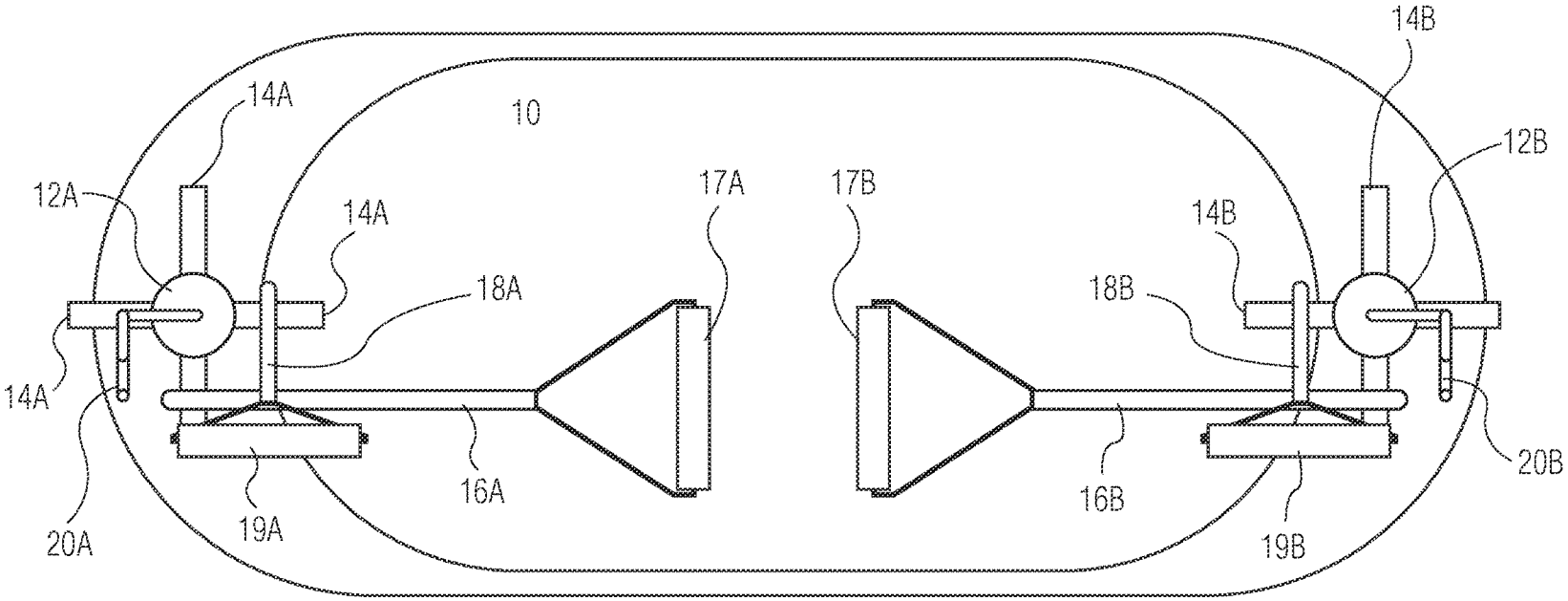
FIG. 2A is a top view of the exercise device of FIG. 1.
Figure 2B:
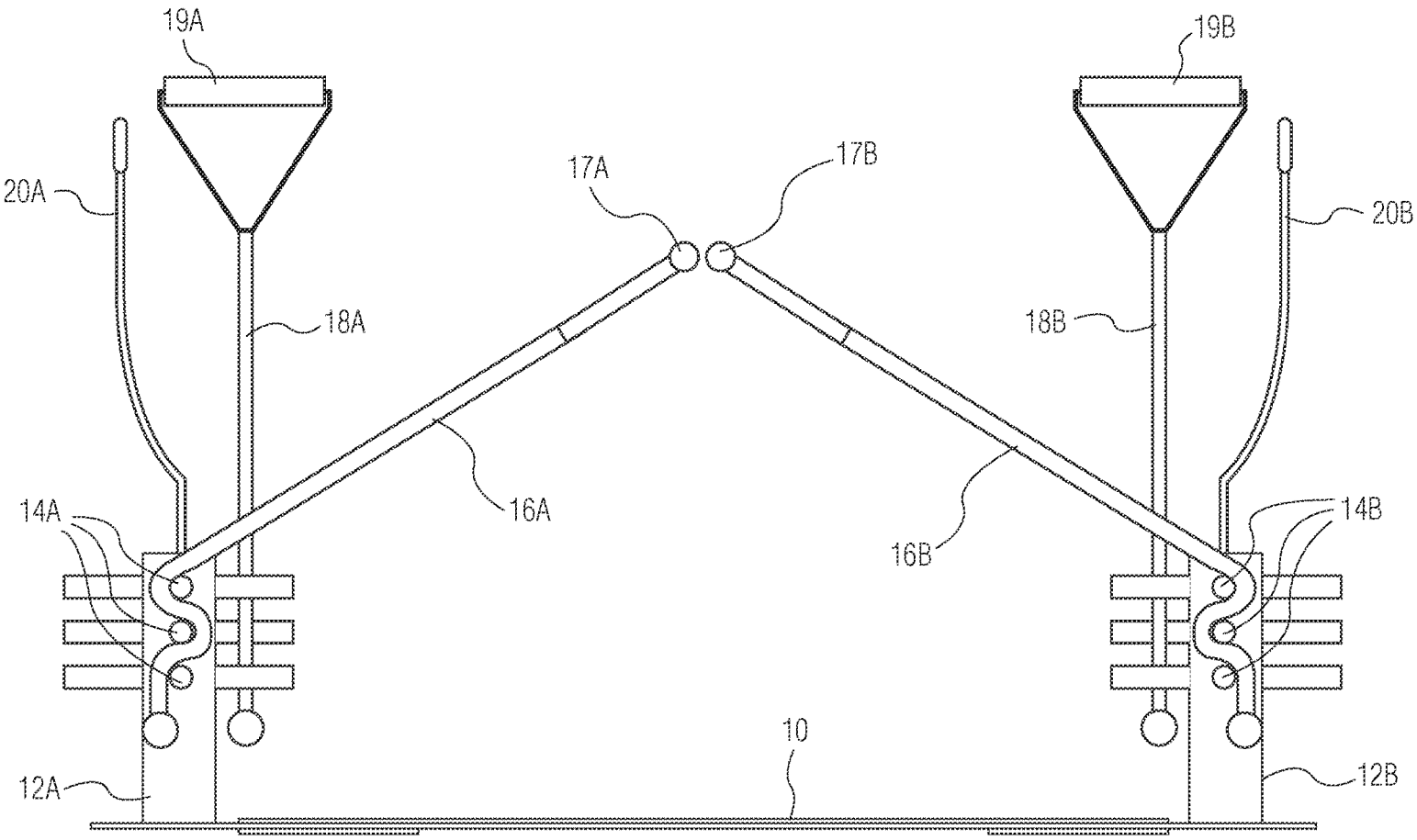
FIG. 2B is a side view of the exercise device of FIG. 1.

As shown the perspective views of FIGS. 1 and 1A, and in the top and side views of FIGS. 2A and 2B, respectively, the device comprises a board or "deck" 10 configured for placing on the floor with at least one, but preferably two, upstanding post members, or "trees" 12A, 12B having "branches" or bars 14A, 14B that can fix and hold one or more elastic bands 16A, 16*b*; 18A, 18B. The device may be used by placing the deck 10 on the floor and stepping on it, or by securing (e.g. bolting) the deck to a wall.

When an elastic band 16A, 16*b*; 18A, 18B is wrapped around two or more "branches" 14A, 14B of the post 12A, 12B, its natural resilience and friction against the adjacent surfaces causes it to stay in place when its free end—which may or may not have a handle 17A, 17B; 19A, 19B—is pulled by the user.

Conveniently, one or more posts may include a "band holder" 20A, 20B to hold the end(s) of the band(s) when it is (they are) not in use.

Figure 3:
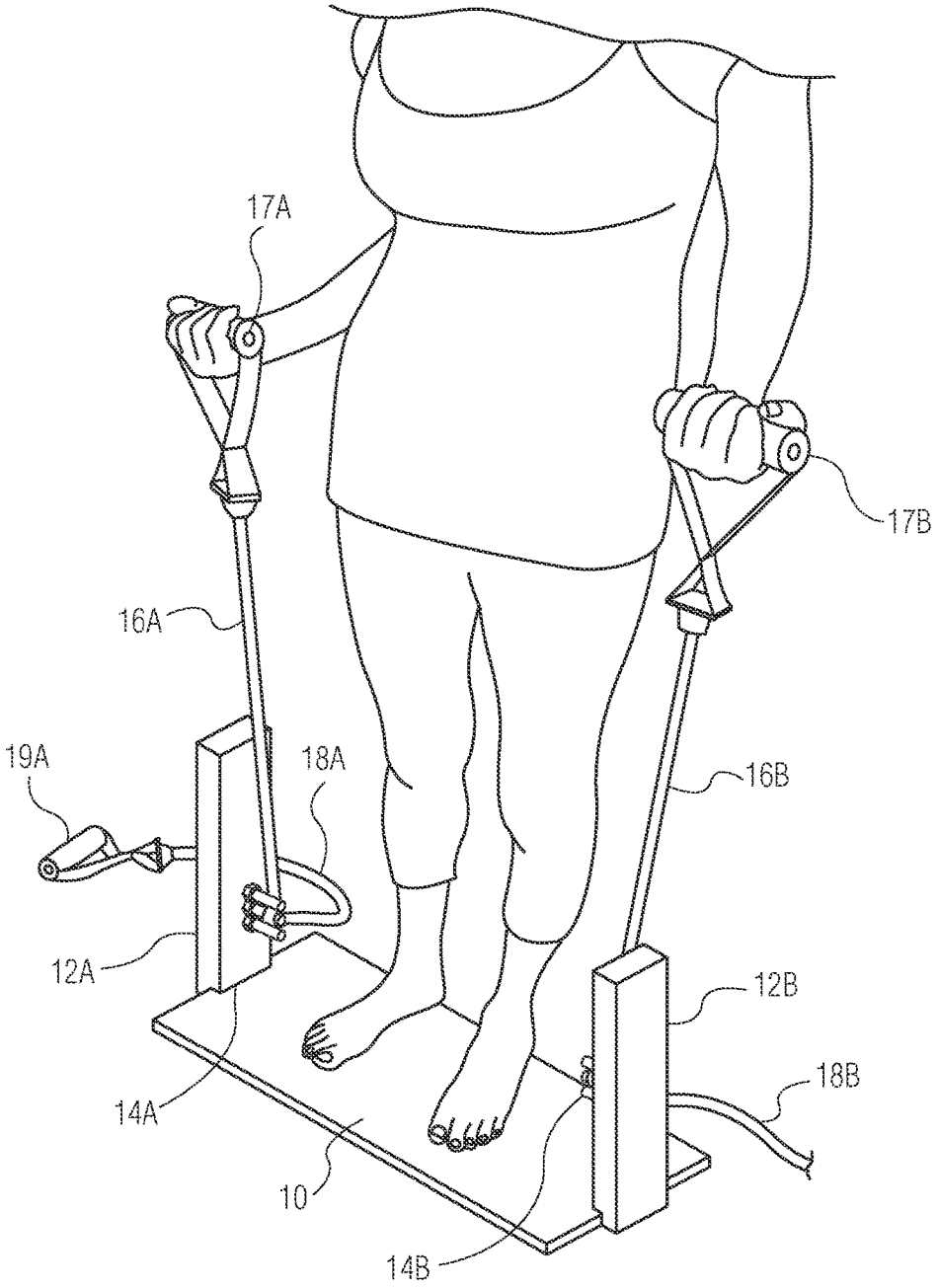
FIG. 3 is a perspective view showing the use of the exercise device of FIG. 1.

The exercise device may be used in the manner shown in FIG. 3. After attaching the elastic bands 16 to the branches 14 of the trees 12, the user stands on the deck 10 and lifts the bands.

The branches 14 on each post 12 allow for complete flexibility in where the user places the bands, varying the length of the bands, thus giving the user infinite combinations of length and tension and weight resistance, in one easy step, with no fasteners or clips or latches. All that is required is to weave the bands around the branches as shown in FIG. 4.

Figure 4:
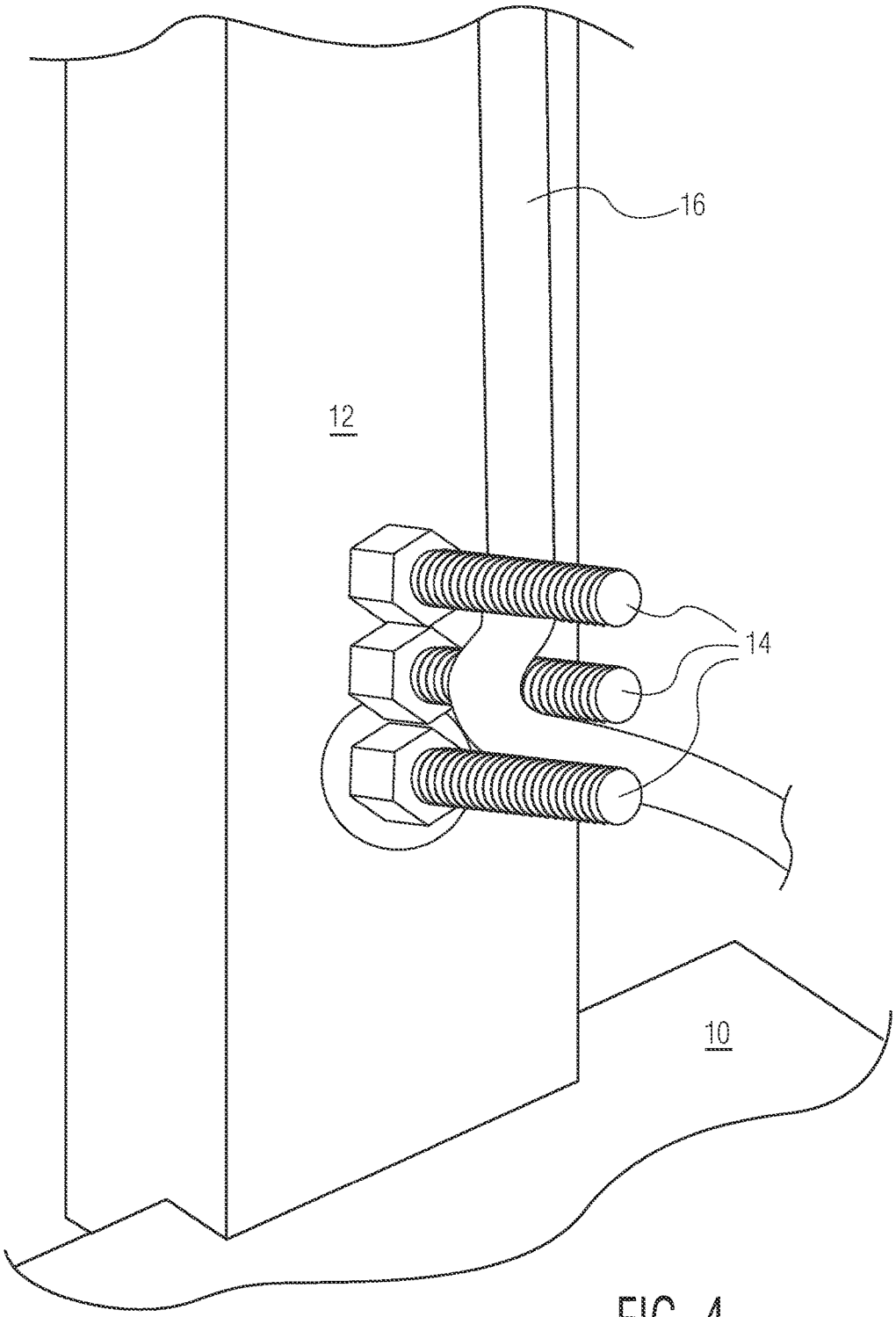
FIG. 4 is a perspective, detailed view of a portion of the exercise device of FIG. 1 showing a connection to an elastic band.
Figure 5A:
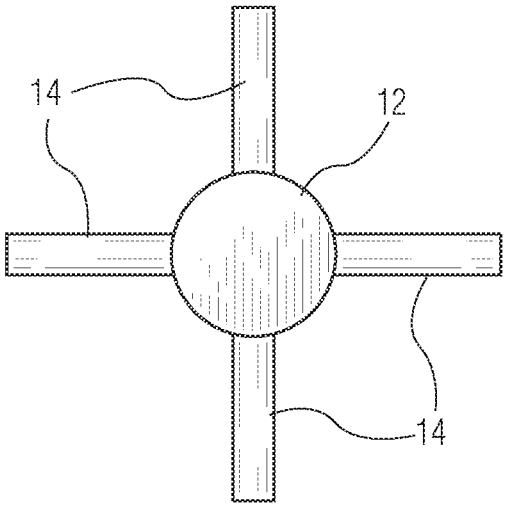
FIGS. 5A and 5B are top and side views of a post or "tree" with four sets of bars or "branches" according to the present invention.
Figure 5B:
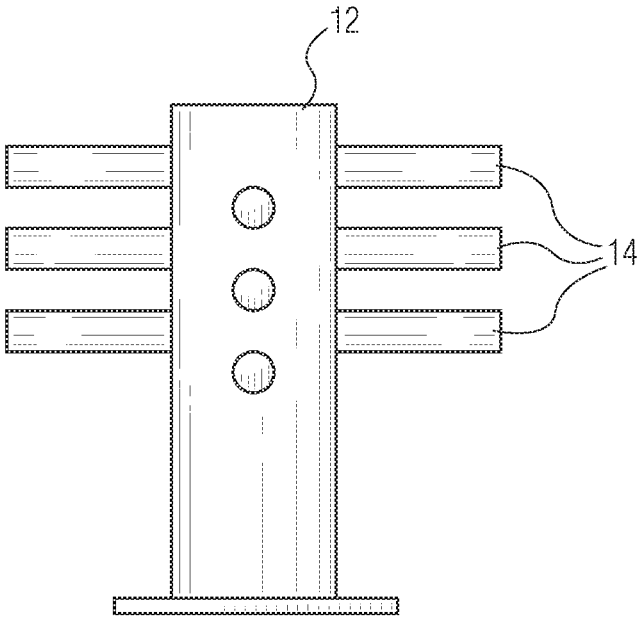
Figure 6A:
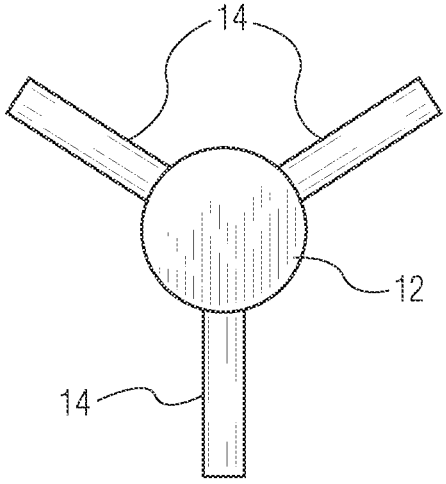
FIGS. 6A and 6B are top and side views of a tree with three sets of branches according to the present invention.
Figure 6B:
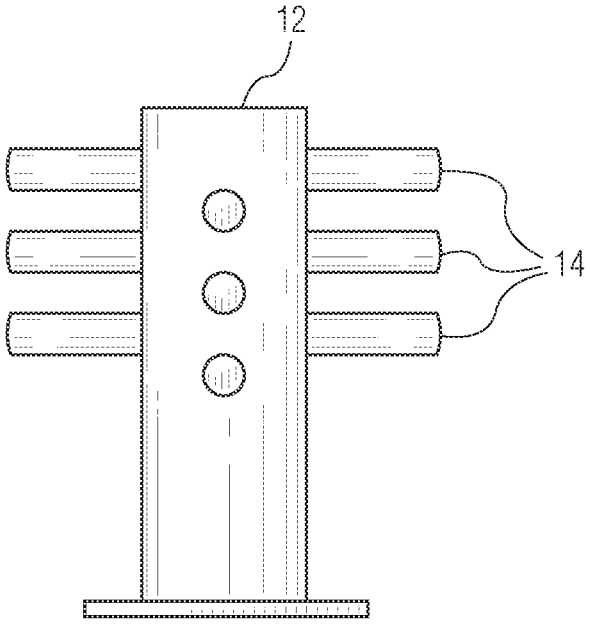
Figure 7A:
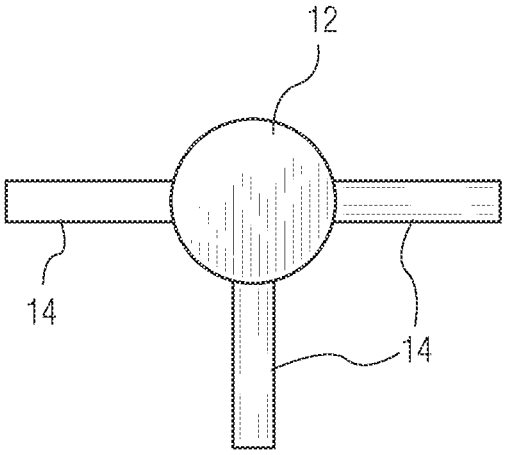
FIGS. 7A and 7B are top and side views of a tree with three sets of branches according to the present invention.
Figure 7B:
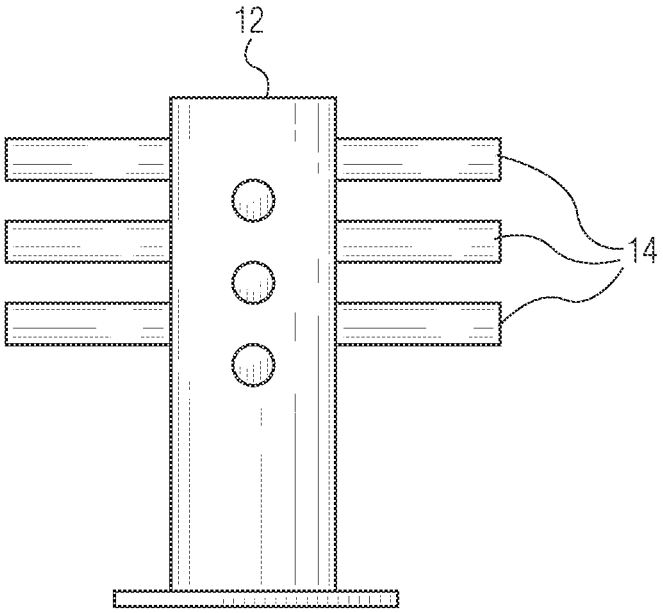
Figure 8A:
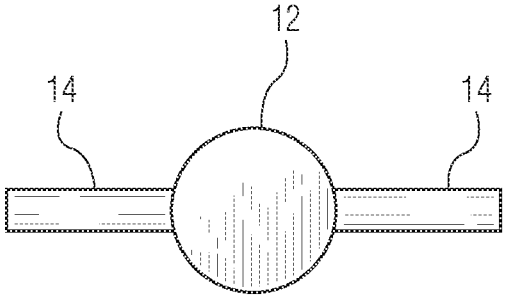
FIGS. 8A and 8B are top and side views of a tree with two sets of branches according to the present invention.
Figure 8B:
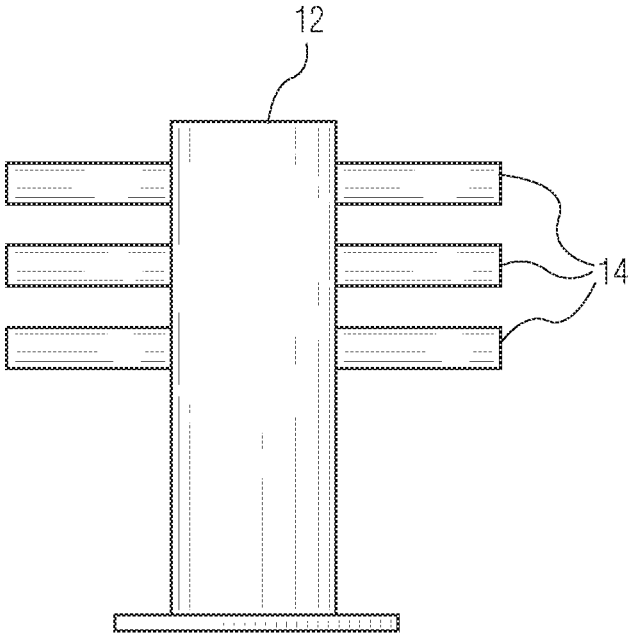
Figure 9A:
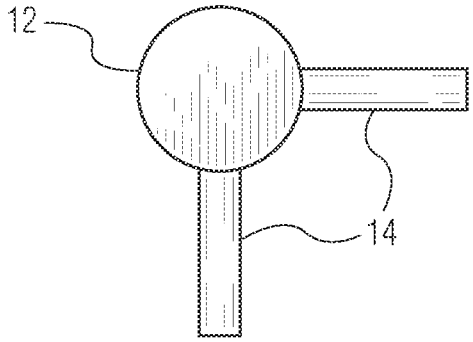
FIGS. 9A and 9B are top and side views of a tree with two sets of branches according to the present invention.
Figure 9B:
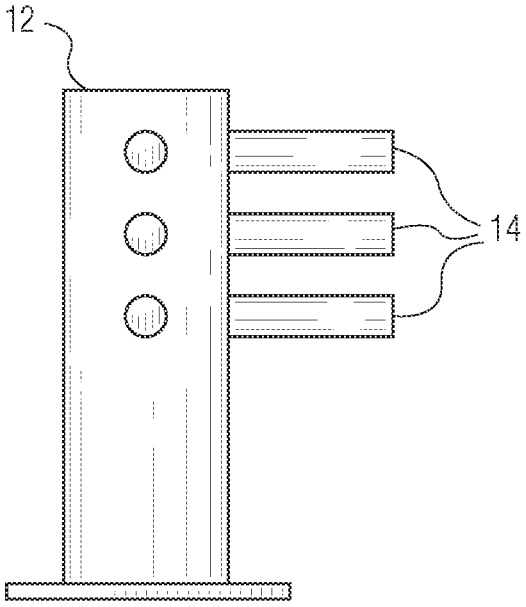

There may be two, three or even four or more branches or bars 14 on a post or tree 12, arranged along a straight line or row as shown in FIG. 4. These branches or bars may be smooth, but are preferably textured, as shown in FIG. 4, to increase their friction with respect to an adjacent elastic band.

The branches 14 also allow for use with any size and thickness of bands, and several bands can be mounted on the branches at the same time, providing increased convenience to the user by not having to change the bands for a variety of exercises.

The post 12 and branches 14 can also be mounted to any other piece of fitness equipment as an accessory and/or option.

FIGS. 5-9 illustrate different configurations of branches 14 on a post 12, in top view 5A, 6A, 7A, 8A, 9A and side view 5B, 6B, 7B, 8B, 9B. As shown, there may be four, three or just two sets of branches 14 arranged in a row.

The device according to the invention allows the user the place his/her feet in any desired position, as compared to the use of conventional bands that require the feet to be placed according to the direction and resistance the user uses the bands for. The device also allows the user to exercise without wearing shoes, sneakers or sandals, which is typically required when exercising with conventional bands.

There has thus been shown and described a novel exercise device which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A exercise device for use with elastic exercise bands, said device comprising:

(a) a substantially planar base member configured to lay or be mounted on the floor, to be mounted on a wall, or to be mounted on a piece of another exercise apparatus;

(b) at least one elongate upstanding post member affixed to the base member and extending substantially perpendicular thereto; and (c) at least two elongate bars affixed to the post member and extending substantially parallel to each other and to the base member, wherein said at bars extend outward at our positions on said at least one post member, spaced apart equally around said post member, whereby one or more exercise bands may be wrapped about the bars for attachment to permit exercise with such bands.

2. The exercise device defined in claim 1, wherein said at least two bars are formed of a metal covered with a polymer layer to increase their friction with an exercise band.

3. The exercise device defined in claim 2, wherein said polymer layer is selected from the group consisting of a rubber, a plastic foam and a plastic elastomer.

4. The exercise device defined in claim 1, wherein the at one elongate upstanding post member comprises two elongate post members affixed to the base member, one on each opposite side of the base member and extending substantially in parallel with each other and substantially perpendicular to said base member.

5. The exercise device defined in claim 1, wherein the at least two elongate bars comprise three bars affixed to said at least one post member and extending substantially parallel to each other and to the base member.

6. The exercise device defined in claim 1, wherein said at least two bars are configured to retain a flat exercise band.

7. The exercise device defined in claim 1, wherein said at least two bars are configured to retain a round exercise band.

8. The exercise device defined in claim 1, wherein said at least two bars have a textured surface to increase their friction with an exercise band.

9. The exercise device defined in claim 1, further comprising a rod attached to and extending upward from the post member having angled portion at the top for holding an end portion of an exercise band.

10. In an exercise device for use with elastic exercise bands, said device comprising:

(a) at least one elongate post member having a longitudinal axis;

(b) a set of at least two straight, elongate bars affixed the post member, extending substantially parallel to each other and substantially perpendicular to said longitudinal axis, whereby one or more exercise bands may be wrapped about the bars for attachment to permit exercise with such bands;

the improvement wherein said set of at least two bars extends outward at at least four different positions on said post member, spaced equally around said post member.

11. The exercise device defined in claim 10, wherein said set of at least two bars are formed of a metal covered with a polymer layer to increase their friction with an exercise band.

12. The exercise device defined in claim 11, wherein said polymer layer is selected from the group consisting of a rubber, a plastic foam and a plastic elastomer.

13. The exercise device defined in claim 10, wherein said set of at least two bars are configured to retain a flat exercise band.

14. The exercise device defined in claim 10, wherein said set of at least two bars are configured to retain a round exercise band.

15. The exercise device defined in claim 10, wherein said set of at least two bars have a textured surface to increase their friction with an exercise band.

* * * * *